United States Patent [19]

Cohen

[11] 4,284,172

[45] Aug. 18, 1981

[54] ADJUSTABLE LADDER EXTENDER ASSEMBLY SAFETY ATTACHMENT

[76] Inventor: Solomon Cohen, 2435-B Tremont St., Philadelphia, Pa. 19115

[21] Appl. No.: 55,492

[22] Filed: Jul. 6, 1979

[51] Int. Cl.[3] ..... E06C 7/44; E06C 7/48

[52] U.S. Cl. ..... 182/204; 182/214; 403/84

[58] Field of Search ..... 182/205, 204, 214, 185, 182/230, 107, 108; 403/84, 101

[56] References Cited

U.S. PATENT DOCUMENTS

| | | | |
|---|---|---|---|
| 2,825,607 | 3/1958 | Watts | 182/230 |
| 3,012,627 | 12/1961 | Mitchell | 182/185 |
| 3,445,129 | 5/1969 | Penote | 182/185 |

*Primary Examiner*—Reinaldo P. Machado

[57] ABSTRACT

A ALEASA for ladders is comprised of three pieces which when attached to one side of a ladder near its base and adjusted will have the effect of lengthening that side to keep the ladder vertical while resting on an angled plane; or when an ALEASA is attached to each side of a ladder near its top and are adjusted, they will have the effect of extending the ladder to rest against a wall while allowing the top of both sides of the ladder to be free of any contact with the wall; or when an ALEASA is attached to a ladder near its top, and adjusted, it will have the effect of extending that side of the ladder to rest against an angled or different wall while keeping the two sides of the ladder parallel with each other.

1 Claim, 9 Drawing Figures

PIECE A

PIECE B

PIECE C

ADJUSTABLE LADDER EXTENDER ASSEMBLY SAFETY ATTACHMENT

The present invention relates to an Adjustable Ladder Extender Assembly Safety Attachment for ladders.

When an Adjustable Ladder Extender Assembly Safety Attachment (FIG. 5) is attached to a ladder near the ladder's base (FIG. 6) so that pieces A and B are parallel with each other and to the side of the ladder, piece C may be adjusted to extend one side of the ladder so that when the ladder is resting on an angled plane, the extended side will have the effect of keeping the ladder in a vertical position.

When an Adjustable Ladder Extender Assembly Safety Attachment is placed on each side of a ladder near the ladder's top (FIG. 7) and pieces B are positioned at an angle to pieces A so that pieces B will be perpendicular to a wall, pieces C may be adjusted to meet the wall and to allow the top of the ladder to be a desired distance from the wall. If pieces C are resting against the wall under an opening such as a window, the top of the ladder will remain away from the window while still within range of easy access.

When an Adjustable Ladder Extender Assembly Safety Attachment is attached to one side of a ladder near the ladder's top (FIGS. 8 and 9) and piece B is positioned at an angle to piece A so that piece B will be perpendicular to a wall, piece C may be adjusted to meet the wall so that the extended side and the top of the other side of the ladder will meet their respective resting places at the same time and allow both sides of the ladder to remain parallel with each other.

The foregoing and other objects and advantages of the invention will become more apparent as the following detailed description is read in conjunction with the drawing, in which.

Figure 6:
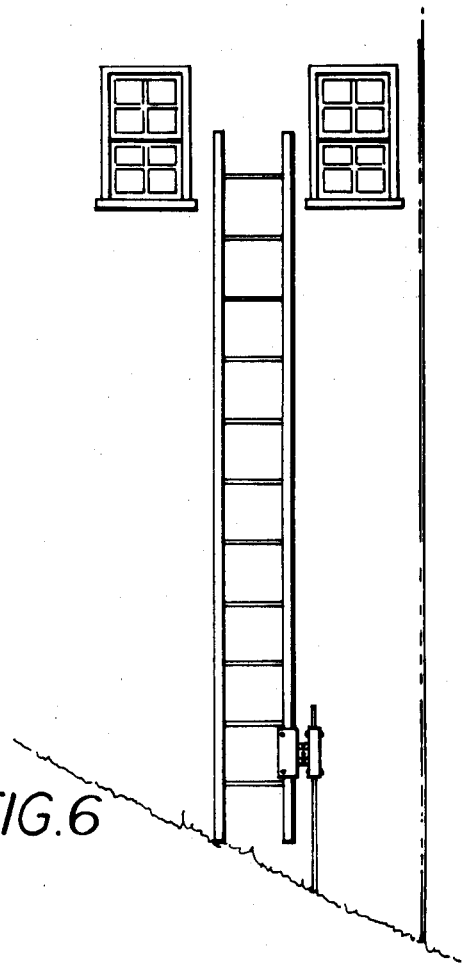
Figure 7:
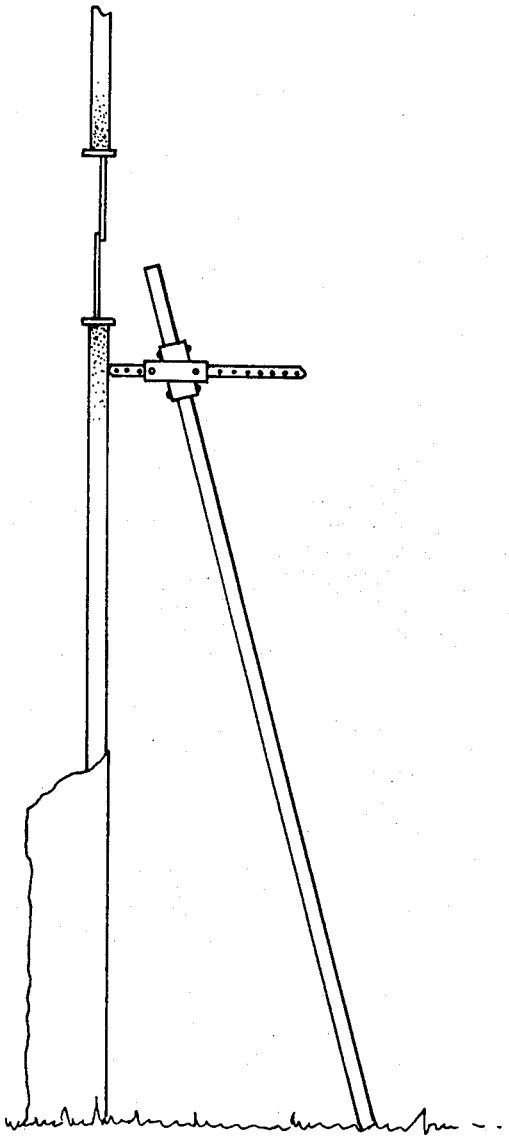
Figure 9:
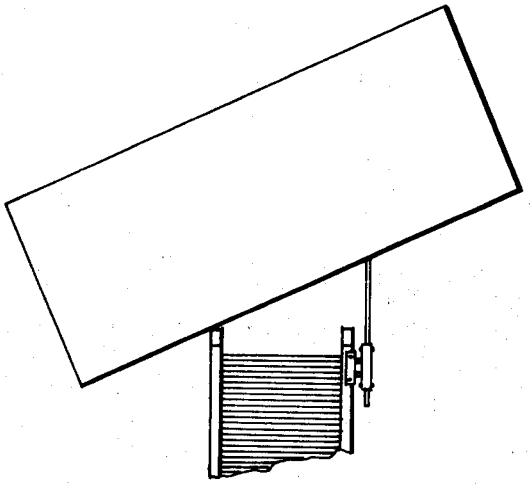
Figure 8:
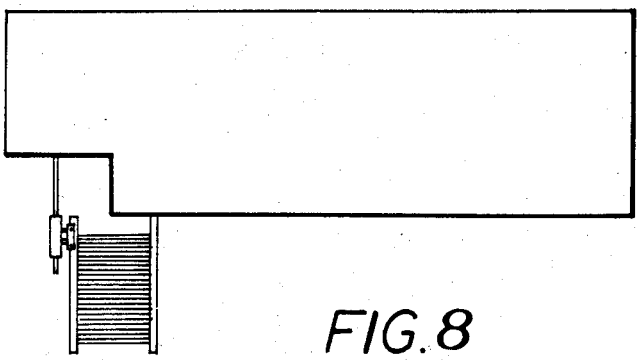

FIG. 6 is an Adjustable Ladder Extender Assembly Safety Attachment shown on a ladder in use on an angled plane, and FIG. 7 is a side view of the Adjustable Ladder Extender Assembly Safety Attachments shown on a ladder in use against a wall below a window, and FIG. 8 is a top view of an Adjustable Ladder Extender Assembly Safety Attachment shown on a ladder in use against a wall other than the wall on which the other side of the ladder is resting, and FIG. 9 is a top view of an Adjustable Ladder Extender Assembly Safety Attachment shown on a ladder in use against a wall situated at an angle to the base of a ladder.

Figure 3:
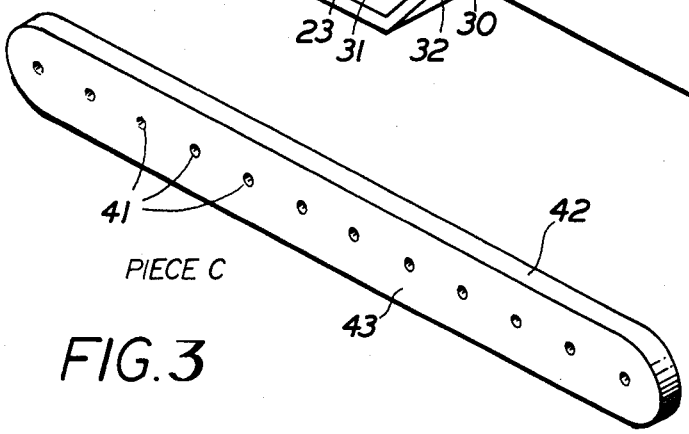
FIG. 3 is an isometric view of Piece C.

FIG. 3 is not drawn to scale. The ends may be rounded, squared or angled; or one side may be rounded and the other side squared or angled; or one end may be squared and the other end angled.

Figure 5:
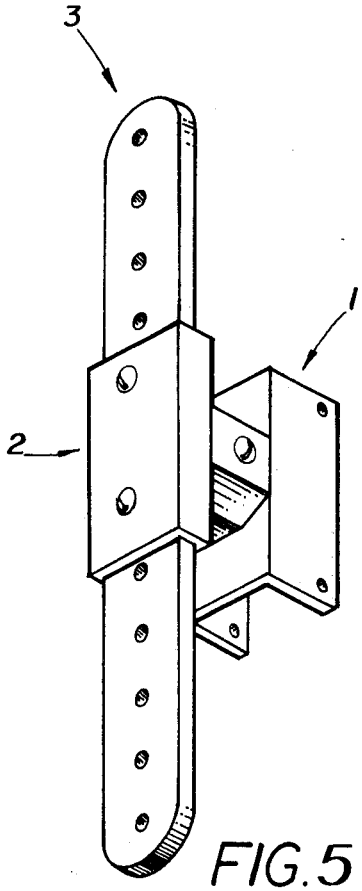
FIG. 5 is an isometric view of Pieces A, B and C assembled.

FIG. 5 forms an adjustable ladder extender assembly safety attachment and is not drawn to scale.

FIGS. 6, 7, 8 and 9 are for purposes of illustration only.

It will, of course, be understood that the description and drawing herein contained are illustrative merely, and that various modifications and changes may be made in the Adjustable Ladder Extender Assembly Safety Attachment without departing from the spirit of the invention disclosed.

Figure 4:
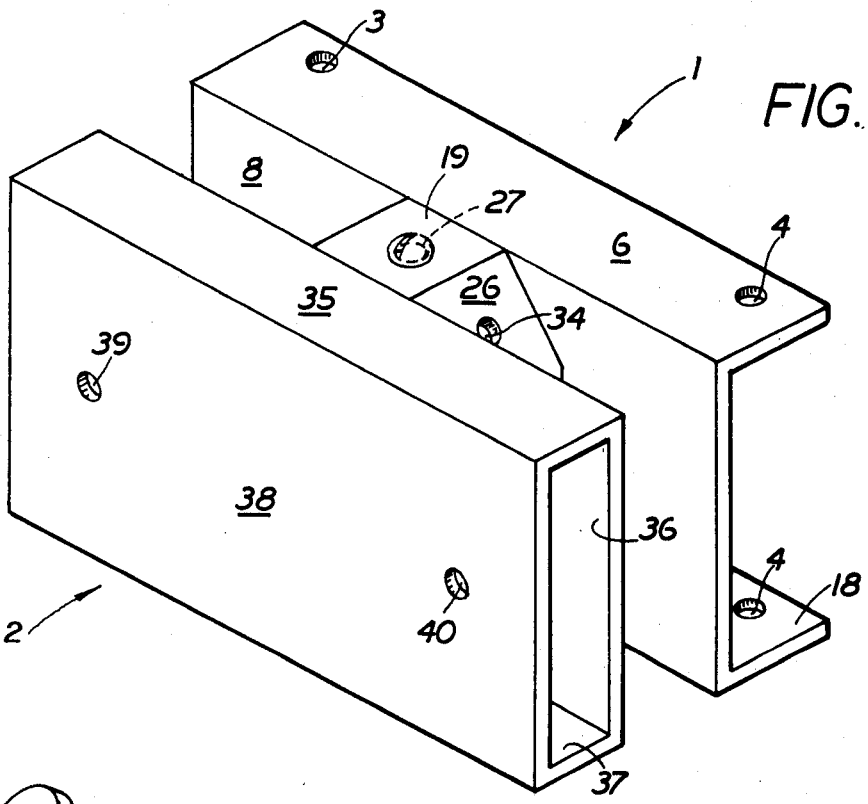
FIG. 4 is an isometric view of Pieces A and B assembled.

Piece A's prism shaped male protrusion (FIG. 1) whose ends may have, but are not limited to, 8 equal sides, is inserted into the female protrusion of Piece B (FIG. 2) and FIG. 4 shows Pieces A and B assembled. Piece C (FIG. 3) is inserted through the rectangular hollow side of Piece B to form an Adjustable Ladder Extender Assembly Safety Attachment (FIG. 5). Piece A of the Adjustable Ladder Extender Assembly Safety Attachment is attached to a side piece of a ladder between two rungs (FIGS. 6, 7, 8 and 9).

Figure 1:
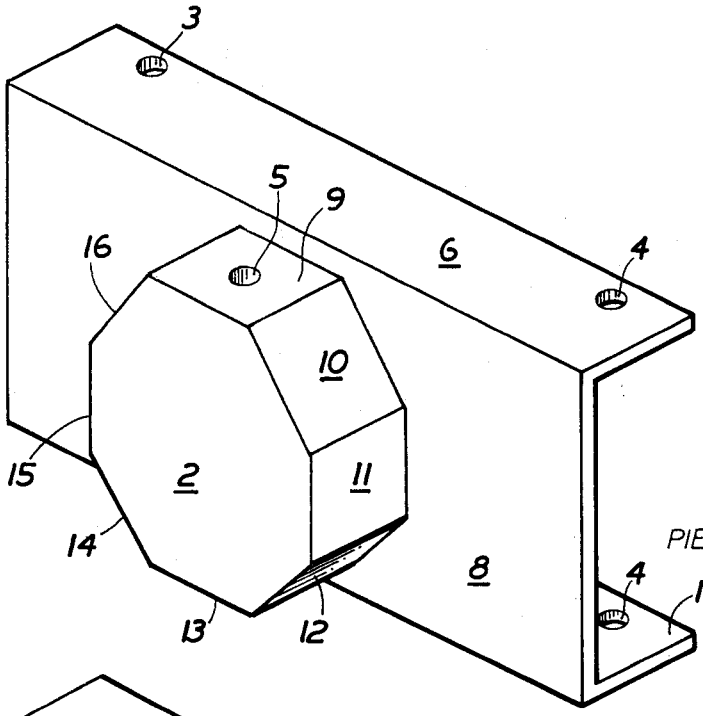
FIG. 1 is an isometric view of Piece A.

FIG. 1 (Piece A) is a channel shaped bracket having three sides (6, 8, 18) and one open side. Two opposing sides (6, 18) contain holes (3, 4) for securing bracket to a ladder or the like. One side (8) has a diverging member (2) of a prism shape and solid and having eight sides (9, 10, 11, 12, 13, 14, 15, 16) with a hole (5) through said diverging member (2) and exposed on two sides (9, 13).

Figure 2:
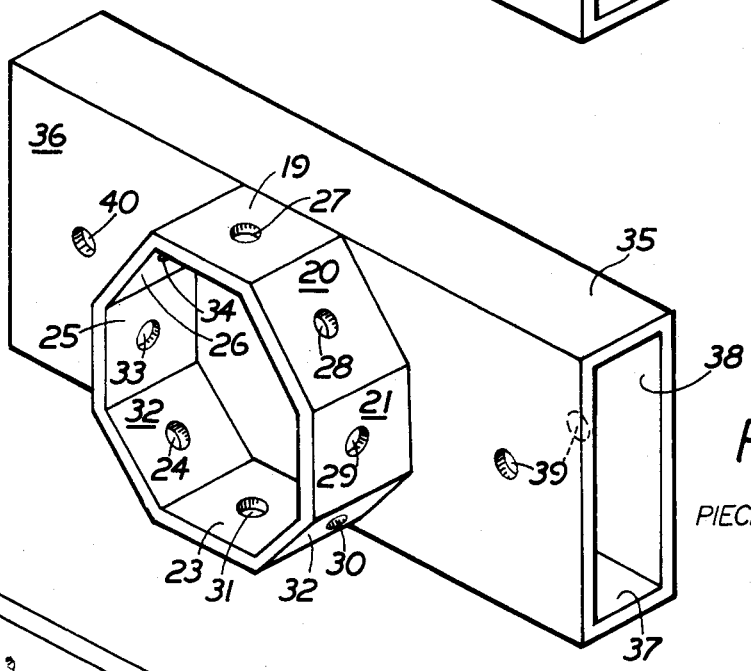
FIG. 2 is an isometric view of Piece B.

FIG. 2 (Piece B) is a hollow channel shaped member having four sides (35, 36, 37, 38) of which one side (36) contains a diverging member of a prism shape and hollow and having eight sides (19, 20, 21, 22, 23, 25, 26, 32), each of which containing a hole (24, 27, 28, 29, 30, 31, 33, 34) dimensioned and positioned to accommodate a bolt or the like for purposes of securing Piece B to Piece A when the diverging members of Pieces A and B are placed in a desired position in relation to each other so as to allow a bolt or the like to be passed through a designated hole in the diverging member of Piece B and the hole in the diverging member of Piece A. The side (36) containing the diverging member also contains two holes (39, 40) which are on either side of the diverging member, and two corresponding holes are contained in the opposite side (38).

FIG. 3 (Piece C) is a bar containing four sides (42, 43 and their two opposite sides) which may be of a solid or hollow construction.

The bar contains a series of holes (41) which are exposed on two opposite sides (43 and its opposing side). The holes are dimensioned and positioned so that when Piece C is passed through the hollow channel of Piece B and so positioned, Piece C will be secured to Piece B when a bolt or the like is passed through the two sets of holes in Piece B and through designated holes in Piece C.

The ALEASA which, in addition to other objects, designs and purposes which may become apparent to those skilled in the art from this disclosure, when attached to a ladder, will satisfy many purposes, including but not limited to:

1. Keeping the crossmembers of a ladder (FIG. 6) horizontal when the device is attached to one side-piece of said ladder and adjusted to meet the lower level of an inclined plane;
2. Keeping the top of the side-pieces of a ladder from touching a wall when two said devices are attached to a ladder (FIG. 7), one on each side-piece, and adjusted to meet a wall so as to permit the tops of the side-pieces of said ladder to be positioned at a desired distance away from said wall; and
3. Keeping the side-pieces of a ladder parallel to and with each other when said device is attached to one side-piece of a ladder (FIGS. 8 and 9) and adjusted to meet that part of a wall or a separate wall which is a greater distance from the top of the side-piece to which said device is attached than that portion of said wall or other wall on which the top of the other side-piece is resting.

The ALEASA may be made of any suitable material and in various sizes and shapes.

I claim:

1. An adjustable ladder extender assembly safety attachment (ALEASA), including

A. A bracket of a channel shaped member having three walls and an open side with a diverging member protruding from the wall opposite and extending away from the open side wherein the diverging member is multi-sided, but preferably an eight-sided prism shaped solid member whose sides are perpendicular to the side to which it is secured and has a hole through the member that is exposed on two sides which are opposite each other, and which are on the same plane as the walls of the channel-shaped member which are adjacent to the open side and holes in both walls adjacent to the open side are dimensioned and positioned to allow for securing the device to a ladder or the like;

B. A hollow member having several walls, but preferably four walls with a diverging member protruding from one wall and protruding away from its opposite wall wherein the diverging member is multi-sided, but preferably an eight-sided prism-shaped hollow member whose sides and walls are perpendicular to the wall on which it is secured and dimensioned to envelope and house the diverging member as described in A above; and C. A bar having several sides, but preferably four sides with a series of holes eminating from one side and each hole being exposed on both the eminating side and its opposite side; and wherein each side of the diverging member as described in B above has a hole dimensioned and designed to allow a bolt or the like to be placed through any two opposite sides of the diverging member and, when so positioned, through the hole in the diverging member as described in A above; and wherein holes are dimensioned and positioned in two opposite walls of the hollow member as described in B above and eminate from the wall on which the diverging member is secured to allow a bar as described in C above to be held in place within the hollow member when said bar is passed through said hollow member and bolts or the like are put through opposing holes in opposite walls of said hollow member, and when so positioned, through designated holes in said bar and wherein the bracket, the hollow member and the bar, as described in A, B and C above, respectively, form the ALEASA, which can be attached to a ladder or the like and adjusted so that said ladder may be placed in any desired position; and wherein the ALEASA may be made of any suitable material; and wherein the ALEASA may be made in various sizes and shapes; and wherein the ALEASA may be modified to accommodate other objects, designs, and purposes, which may become apparent to those skilled in the art from this disclosure.

* * * * *